US005413399A

United States Patent [19]

Myers et al.

[11] Patent Number: 5,413,399

[45] Date of Patent: May 9, 1995

[54] MULTIPURPOSE HIGHCHAIR AND SWING WITH DETACHABLE SEAT

[75] Inventors: Peter J. Myers; Philip M. Baerenwald, Both of Plano, Tex.

[73] Assignee: Today's Kids, Inc., Boonesville, Ark.

[21] Appl. No.: 192,138

[22] Filed: Feb. 4, 1994

[51] Int. Cl.[6] ..... A47D 11/00

[52] U.S. Cl. ..... 297/118; 297/130; 297/281; 297/183.1

[58] Field of Search ..... 297/118, 130, 183, 273, 297/281; 272/85, 86

[56] References Cited

U.S. PATENT DOCUMENTS

| | | | |
|---|---|---|---|
| D. 311,822 | 11/1990 | Meeker | D6/333 |
| 565,047 | 10/1896 | Tardis . | |
| 674,910 | 5/1901 | Dutton . | |
| 731,197 | 6/1903 | Marqua . | |
| 825,984 | 7/1906 | Schmersahl . | |
| 830,487 | 9/1906 | Backe et al. . | |
| 1,089,276 | 3/1914 | Seeger . | |
| 1,362,489 | 12/1920 | Karschitz . | |
| 2,494,581 | 1/1950 | Prigg . | |
| 2,533,019 | 12/1950 | Ketcham . | |
| 3,256,016 | 6/1966 | Berlin . | |
| 3,731,420 | 5/1973 | Crosman | 46/1 R |
| 4,271,627 | 6/1981 | Echterling | 46/15 |
| 4,325,578 | 4/1982 | Borucki | 297/281 |
| 4,645,261 | 2/1987 | Bourne et al. | 297/130 X |
| 4,664,396 | 5/1987 | Pietrafesa | 280/30 |
| 4,688,850 | 8/1987 | Brownlie et al. | 297/183 X |
| 4,697,845 | 10/1987 | Kamman | 297/130 X |
| 4,744,599 | 5/1988 | Jankowski et al. | 297/250 |
| 4,807,872 | 2/1989 | Spilman et al. | 272/86 |
| 5,238,291 | 8/1993 | Alionis | 297/118 |

FOREIGN PATENT DOCUMENTS

| | | | |
|---|---|---|---|
| 320004 | 11/1902 | France | 297/273 |

*Primary Examiner*—Peter R. Brown
*Attorney, Agent, or Firm*—Kirkpatrick & Lockhart

[57] ABSTRACT

A chair capable of functioning as a highchair, a swing, a doll carrier, a floor feeder and an automobile seat for a child's doll is disclosed. A frame member consisting of two upstanding support members that are interconnected by horizontal cross members is provided. A chair member having a hook member formed therein is removably attachable to the frame in a highchair-like position. A handle member is attached to the seat member for carrying the seat member apart from the frame and for pivotally supporting the seat member from the frame so that the seat may pivot between the upstanding support members in a swinging manner. A tray member may also be attached to the seat member.

13 Claims, 8 Drawing Sheets

MULTIPURPOSE HIGHCHAIR AND SWING WITH DETACHABLE SEAT

BACKGROUND OF THE INVENTION

FIELD OF THE INVENTION

The present invention relates to chairs and, more particularly, is directed to toy chairs that can selectively function as highchairs, swings, doll carriers, floor feeders and automobile seats for supporting a child's doll.

DESCRIPTION OF THE INVENTION BACKGROUND

Perhaps some of the fondest memories of most people's childhood experiences are the times spent playing with a favorite doll. Boys and girls alike often pass the hours by having their favorite doll mimic various human activities such as eating and playing with toys. In many instances, the child may prop the doll into his or her high chair to facilitate feeding the doll with imaginary or toy food items. After the child has fed the doll, the doll might be afforded a ride on one of the child's toys such as the child's swing.

Over the years, a variety of different articles of toy furniture have been developed for supporting children's dolls in arrangements that mimic various human activities. One need only visit a local toy store to discover that a myriad of different types and sizes of highchairs, cradles, swings, etc. exist for supporting children's dolls. When sold separately, such items can prove to be expensive and are often difficult to store.

To address such problems, a number of different items of doll furniture have been developed that are capable of performing multiple functions. For example, U.S. Pat. No. 4,664,396 to Pietrafesa discloses an article of toy furniture that can function as a highchair, a cradle, a car seat, and a stroller for a child's doll. That multi-functional apparatus, however, cannot function as a swing.

An apparatus that is capable of functioning as a highchair and swing for a child's doll is disclosed in U.S. Pat. No. 4,271,627 to Echterling. The Echterling device comprises a frame assembly that includes a pair of U-shaped legs that are interconnected by an upper support member that has two upwardly extending support portions formed thereon. The apparatus includes a doll supporting seat that can be supported on the support portions in a highchair-like arrangement or it can be pivotally suspended from the support portions by a separate support member. This apparatus, however, can only function as a swing or a highchair.

Yet another convertible highchair and swing arrangement is disclosed in U.S. Pat. No. 5,238,291 to Alionis. The highchair and swing arrangement disclosed in that patent comprises a frame member that has a seat member pivotally attached thereto. The seat member has two occupant supporting sides such that the seat may be pivoted to a first position wherein it functions as a highchair and a second position wherein it is pivotally supported on the frame. Such apparatus, however, can only function as a highchair or a swing.

Often, items of doll supporting furniture are patterned after furniture that has been developed to support a child or an infant. Such children's furniture is perhaps even more expensive and difficult to store and, thus, manufacturers of children's furniture have also found it advantageous to develop multi-functional furniture items. For example, U.S. Pat. No. 565,047 to Tardis discloses a combined baby chair, swing and crib. That apparatus, however, requires a large and cumbersome frame member for supporting the chair member therefrom. In the alternative, Tardis teaches that his chair can be suspending in a swinging manner in doorway. The chair of such apparatus, however, is not equipped with means for transporting it apart from the frame.

Another combined child-supporting chair, swing, and jumper apparatus is disclosed in U.S. Pat. No. 1,089,276 to Seeger. That patent discloses a seat member that can be suspended from a structure to form a swing. The seat member is also equipped with hook members to enable the seat member to be attached to the back of a chair to form a highchair. The seat member, however, is not well suited for transporting a child or child's doll therein.

Yet another combination baby jumper and wheeled chair arrangement is disclosed in U.S. Pat. No. 731,197 to Marqua. The apparatus disclosed in that patent comprises a freestanding frame member that is capable of supporting a wheeled chair therefrom. The wheeled chair has an elongated handle attached thereto that provides a means for pushing the wheeled chair on a surface when it has been detached from the frame. The frame member has an overhead crossbrace from which the chair may be suspended by coil springs that are attachable to the handle member. Due to the elongated nature of the handle, it could not be used to carry or transport the chair. Furthermore, the chair could not function as an automobile seat or floor feeder.

Thus, there is a need for a multipurpose chair that can function as a highchair, a swing, a baby carrier, a floor feeder and an automobile seat.

There is a further need for a device that has the capabilities recited immediately above that can be easily transported by a child and that is relatively economical to fabricate.

SUMMARY OF THE INVENTION

In accordance with the present invention, there is provided a highchair that comprises a frame member that has two upstanding support members that are interconnected in a spaced-apart relationship. A preferred version of the apparatus also comprises a seat member that is equipped with apparatus for removably attaching the seat member to the frame member in a fixed occupant supporting position. A handle member is also attached to the seat member for transporting the seat member apart from the frame member. The handle is provided with pivot members that are adapted to detachably suspend the seat member from the upstanding support members in a position wherein the seat member can pivotally swing between the upstanding support members.

Accordingly, the present invention provides a chair apparatus that can selectively function as a highchair and a swing. The seat member is also capable of being detached from the frame such that it can be transported apart from the frame by the handle to enable the seat member to also function as a baby carrier, floor feeder and car seat. In addition to those features, other details, objects, and advantages will become apparent as the following detailed description of the present preferred embodiment thereof proceeds.

BRIEF DESCRIPTION OF THE DRAWINGS

In the accompanying drawings, there is shown a present preferred embodiment of the invention wherein like reference numerals are employed to designate like parts and wherein:

FIG. 11 is a top view of a preferred chair, handle and tray assembly of the present invention.

DETAILED DESCRIPTION OF THE PREFERRED EMBODIMENTS

Figure 1:
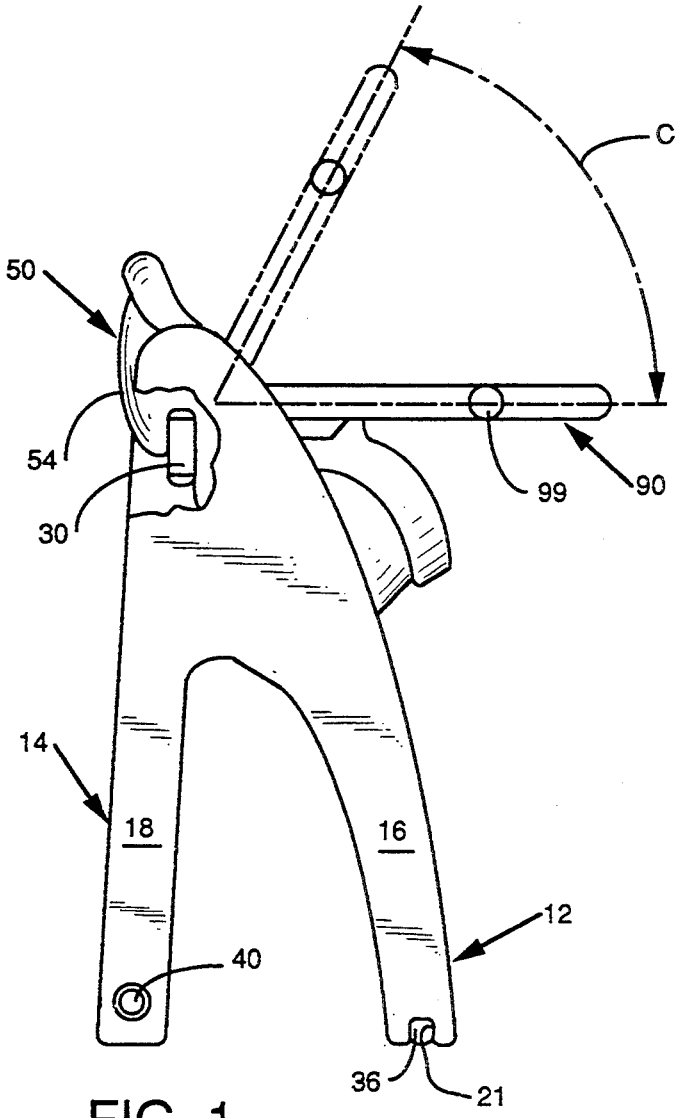
FIG. 1 is a side elevational view of the chair and frame assembly of a preferred embodiment of the present invention with the chair being attached to the frame in a highchair-like position.

Referring now to the drawings for the purposes of illustrating the present preferred embodiment of the invention only and not for purposes of limiting the same, the Figures show a multipurpose toy chair apparatus generally designated as 10. While the multipurpose chair 10, as described below, is preferably constructed to support a child's doll or stuffed toy, those of ordinary skill in the art will appreciate that the multipurpose chair 10, if built in accordance with applicable safety standards, may be constructed to accommodate an infant or a small child.

Figure 2:
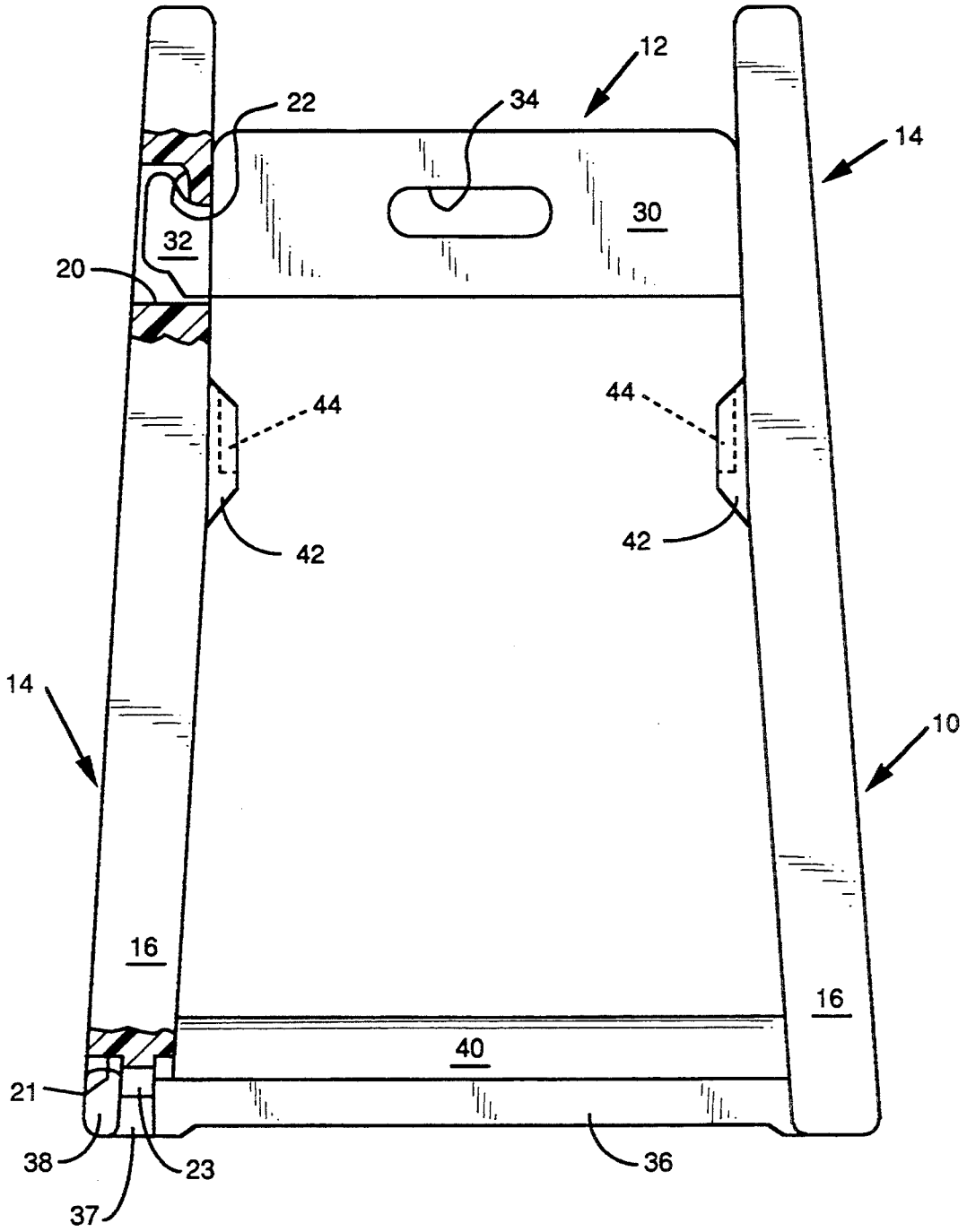
FIG. 2 is a front elevational view of a preferred frame of the present invention.

More particularly, and with reference to FIGS. 1 and 2, the apparatus 10 consists of a frame member generally designated as 12 and a seat member generally designated as 50. The frame member 12 consists of two upstanding lateral support members 14, upper and lower horizontal crossbraces 30 and 36, respectively, and a lower rear brace member 40. In the preferred embodiment, the above-described components of frame 12 are fabricated primarily from molded plastic and are generally constructed to snap together. However, it will be appreciated that the frame member 12 may be fabricated from any other known material from which high chairs or swings are fabricated, such as metal or wood. Further, the frame member 12 may be molded as one piece or, in the alternative, may consist of a number of component parts which are fastened together by other known fastening means such as, for example, bolts or screws.

As shown in FIGS. 1 and 2, the frame member 12 includes two upstanding lateral support members 14 that are the mirror image of one another and each preferably comprise slightly curved members with front and rear leg members 16 and 18, respectively. The lateral support members 14 are fastened together in spaced apart relationship by an upper horizontal crossbrace 30, a lower front horizontal crossbrace 36 and a rear crossbrace 40.

As most particularly shown in FIG. 2, a hook-shaped member 32 is formed into each end of the upper crossbrace 30 for attaching the upper crossbrace 30 to the upstanding lateral support members 14. More specifically, a slot 20 is provided in each lateral support member 14 that is adapted to receive a corresponding hook-shaped member 32 therein. Each slot 20 has a webbed portion 22 formed therein that is adapted to engage a corresponding hook-shaped portion 32 and thus affix the upper crossbrace 30 to the corresponding upstanding lateral support member 14. It will be appreciated, however, that the horizontal crossbrace 30 may be attached to the upstanding lateral support members 14 by a myriad of other known fastening means. Also, the horizontal crossbrace 30 preferably has a centrally located slot 34 therein (See FIG. 1) that serves as a convenient gripping handle for transporting the multipurpose chair apparatus 10.

Figure 3:
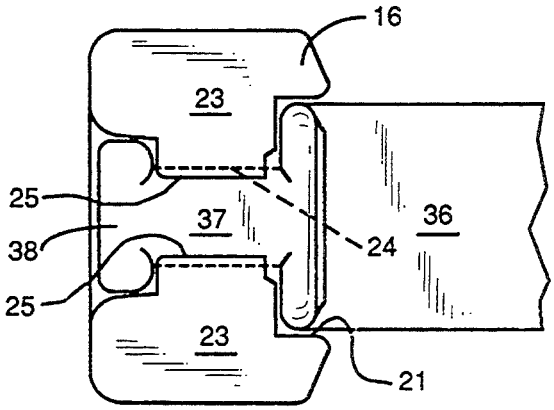
FIG. 3 is a bottom view of a front leg member and a lower front crossbrace assembly of the present invention.

The lower crossbrace 36 extends between the front legs 16 of the upstanding support members 14 and is preferably attached thereto in the manner depicted in FIGS. 2 and 3. More specifically, each front leg 16 has a slot 21 therein adapted to receive a corresponding end of the lower crossbrace 36 therein. A shoulder member 23 is provided in each slot 21 and serves to define a narrow cavity 24 that is adapted to receive a corresponding narrow portion 37 that is provided on each end of the crossbrace 36. Formed into the shoulder 23 are two engagement tabs 25 (See FIG. 3) that are adapted to be snapped into engagement with the corresponding narrow portion 37 of the lower crossbrace 36. An enlarged end portion 38 is provided on each end of the crossbrace 36 to prevent any substantial lateral displacement of the crossbrace 36 when the narrow portions 37 are received within the corresponding shoulder members 23. It will be understood, however, that the lower crossbrace 36 may be provided in a number of other shapes and configurations and may be fastened to the front legs 16 of the upstanding support members 14 by any fastening means that is compatible with the material comprising the crossbrace 36 and the lateral support members 14.

Referring now to FIGS. 1 and 2 the frame 12 also includes a rod-shaped rear crossbrace 40 that extends between the rear legs 18 of the upstanding support members 14. The rear crossbrace 40 preferably has a series of right-handed threads provided on its one end and a series of left-handed threads provided on its other end that are adapted to be threadedly received corresponding internally threaded bores 19 located in each of the rear legs 18. Although the rear crossbrace is preferably a hollow plastic rod with the above-described threads molded into its ends, it will be appreciated that the rear crossbrace 40 may be fabricated from a number of different materials and be fastened to the upstanding support members 14 by any appropriate fastening means. The reader will appreciate that the frame member 12 is somewhat similar in design to the frame disclosed in U.S. Pat. No. 5,238,291, the disclosure of which is herein incorporated by reference.

In a preferred embodiment, two cradle members 42 are formed on the upstanding lateral support members 14. Each cradle member 42 has an upwardly extending open-ended slot 44 therein, the purpose of which will be discussed in further detail below.

Figure 4:
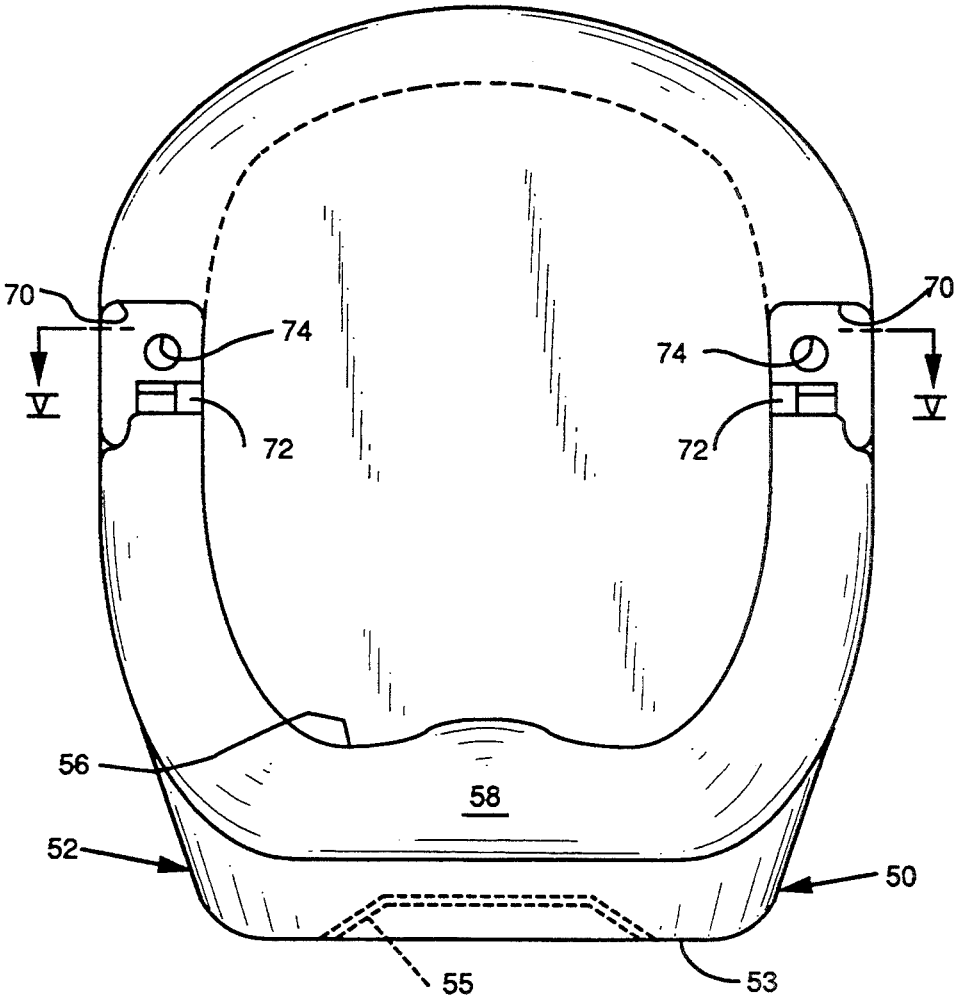
FIG. 4 is a front elevational view of a preferred seat member of the present invention.
Figure 5:
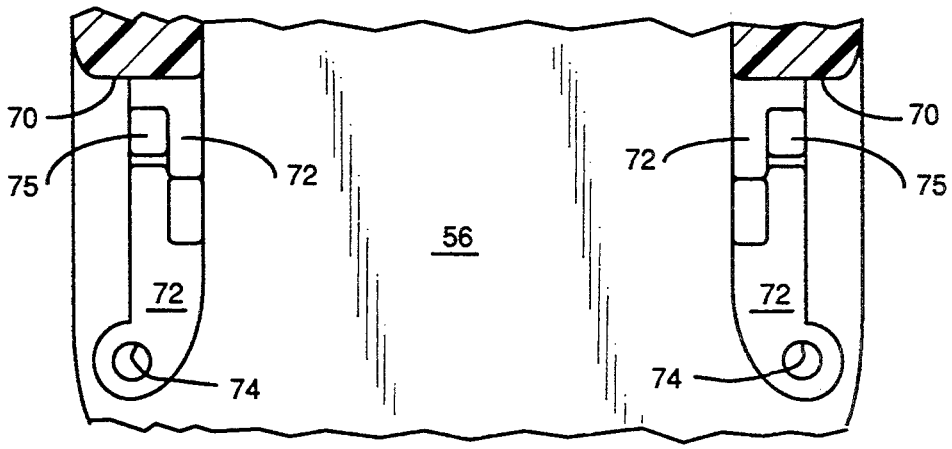
FIG. 5 is a partial cross-sectional view of the seat member taken along line V—V of FIG. 4.
Figure 6:
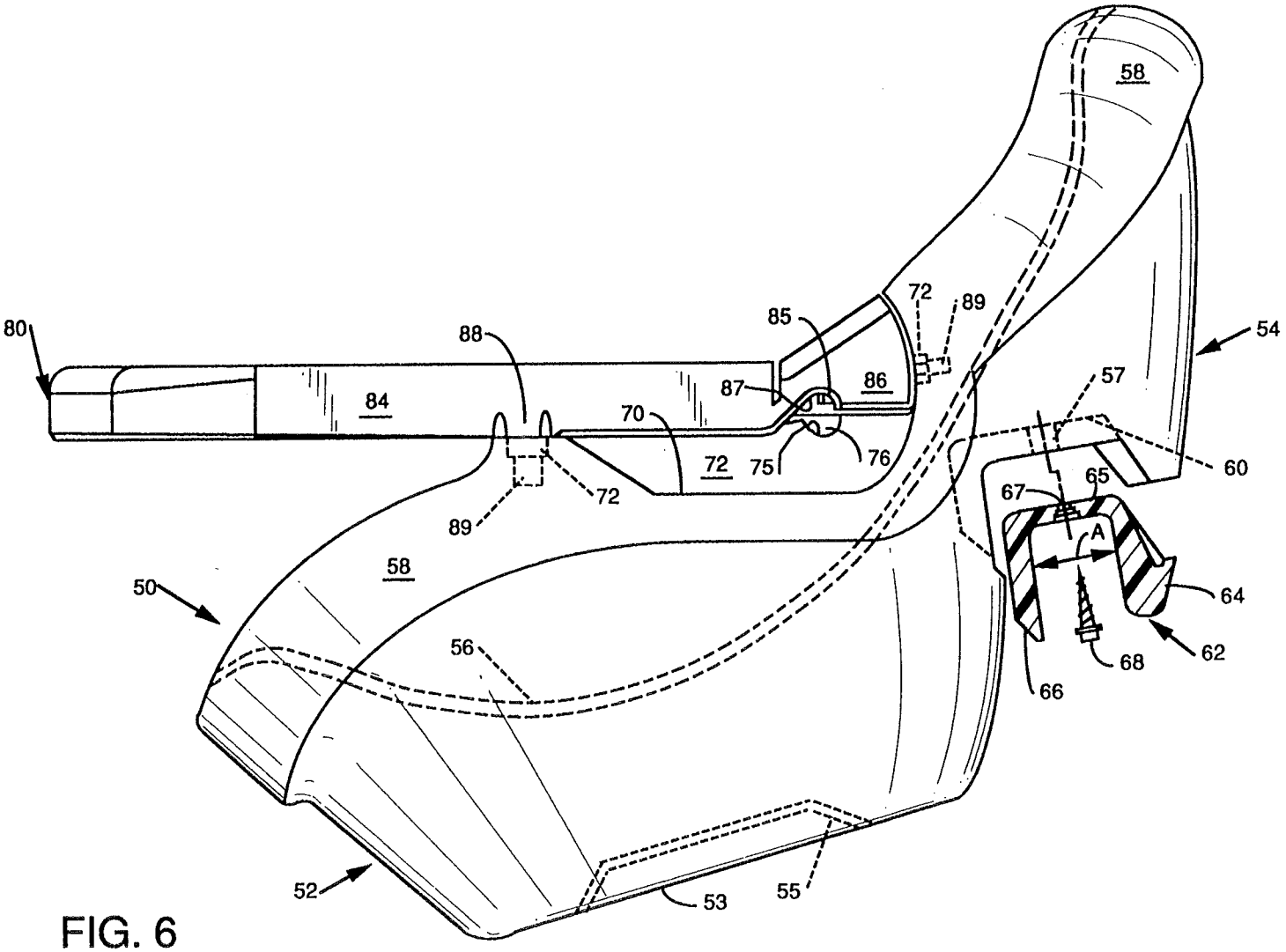
FIG. 6 is a side elevational view of a preferred seat member and tray assembly of the present invention.

The seat member 50 of the subject invention is preferably fabricated from blow-molded high density polyethylene in the shape depicted in FIGS. 4–6. The seat member 50 preferably has a bottom portion 52 and a rear portion 54 and a substantially concave occupant supporting surface 56 that is shaped as shown in FIG. 6. Also, in a preferred embodiment, the seat member 50 is formed with an enlarged frame portion 58 that extends around the upper perimeter of the seat member 50.

As can be seen in FIGS. 4 and 6, the bottom portion 52 of seat member 50 has a substantially planar surface 53 and a cavity 55 formed therein to enable the chair member 50 to be supported in an upright position on a planar surface. Such preferred seat member construction enables the seat member 50 to function as a car seat or a floor feeder because it serves to orient the seat member 50 in a position wherein the occupant thereof would be supported in an upright seated position when the seat is placed on a surface such as a floor or an automobile seat.

The bottom portion 52 of the seat member 50 preferably cooperates with the rear portion 54 to form a U-shaped cavity 60 in the rear of the seat member 50. U-shaped cavity 60 is sized to receive a clip member 62 that is preferably fabricated from high impact polypropylene. More specifically, as can be seen in FIG. 6, the clip member 62 is U-shaped with two spaced-apart leg portions (64, 66) that are interconnected by a base member 65. Preferably, the U-shaped clip member 62 is sized to be received in the U-shaped cavity 60 and retained therein by appropriately sized conventional screws 68 that extend through corresponding countersunk bores 67. The skilled artisan will appreciate that a plurality of (preferably two) screw receiving apertures 57 are molded into the rear portion 54 of seat member 50 by known methods to receive corresponding screws 68. The distance between leg portions (64, 66), generally designated as "A", is sized such that the clip member 62 can be hooked over the upper crossbrace 30 to rigidly and removably fix the seat member 60 to the upper crossbrace 30 in a highchair-like position. See FIG. 1. It will also be appreciated, however, that the rear portion 54 of seat member 50 may be molded such that the clip member 62 may be omitted. It will be further appreciated that a separate hook arrangement could also be attached to the rear portion 54 by known fastening methods to enable the seat member 50 to be attached to the upper crossbrace 30.

Figure 7:
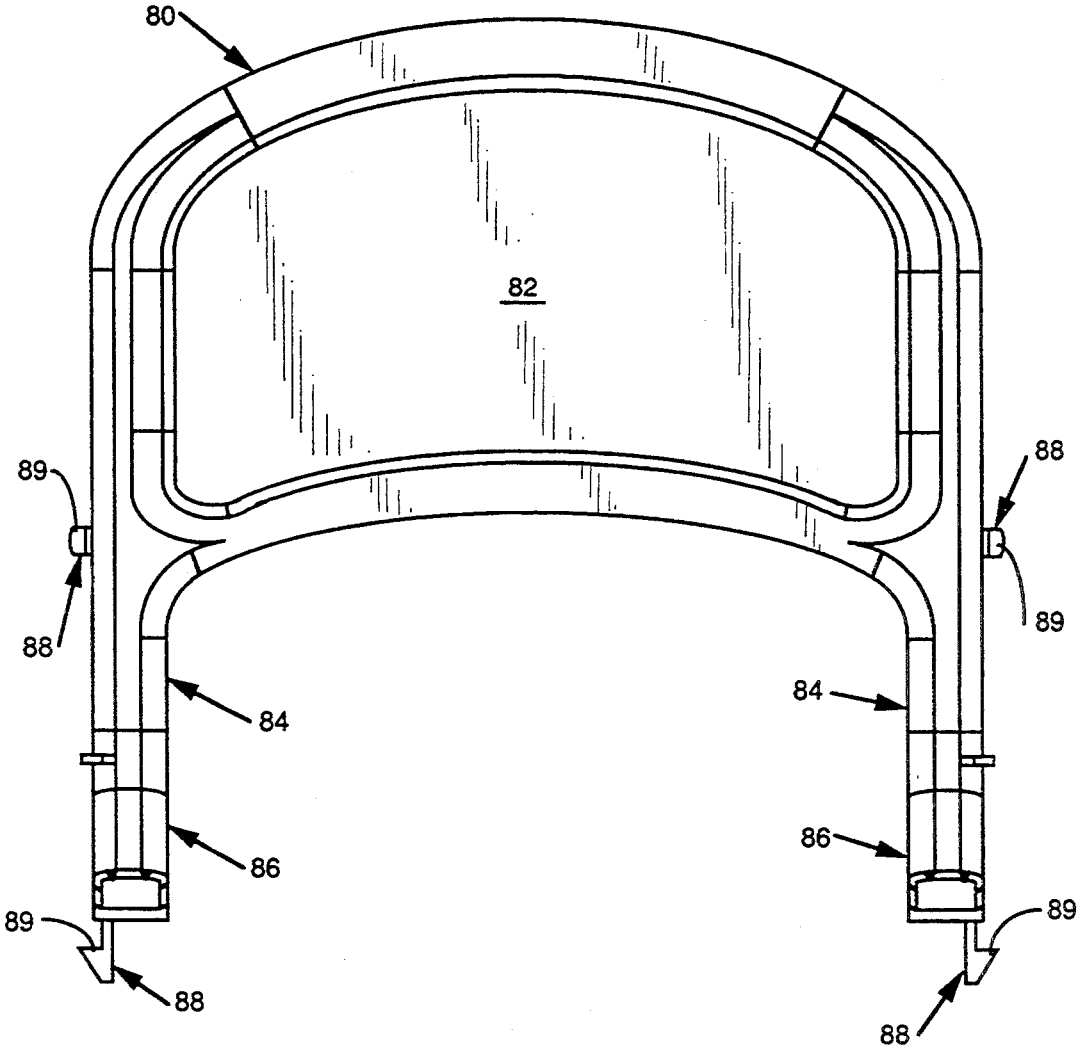
FIG. 7 is a plan view of a preferred tray member of the present invention.

As can be seen in FIGS. 6 and 7, in a preferred embodiment, the seat member 50 has a tray member 80 attached thereto. A preferred tray member configuration is most particularly illustrated in FIG. 7 and comprises an arcuate tray portion 82 that has two spaced-apart support arms 84 protruding therefrom. In a preferred embodiment, tray member 80 is molded from polypropylene in one piece construction. As can be seen in FIG. 6, the rear portions 86 of the support arms 84 are somewhat arcuate in shape such that they can conform to the shape of corresponding arcuate shaped cavities 70 provided in the frame member 58 of seat member 50. The tray member 80 is preferably removably attached to the seat member 50 by a plurality of connection tabs 88 that have engagement members 89 formed thereon. In particular, each of the connection tabs 88 are adapted to be received in a corresponding bore 74 provided in the frame 58. See, FIGS. 4–6. The skilled artisan will appreciate that the engagement members 89 on the tabs 88 are adapted to engage the bottom of the bores 74 to retain the tabs 88 therein in a known manner. The reader will also appreciate that the tray member 80 may be attached to the seat member 50 in a variety of other known manners.

Figure 8:
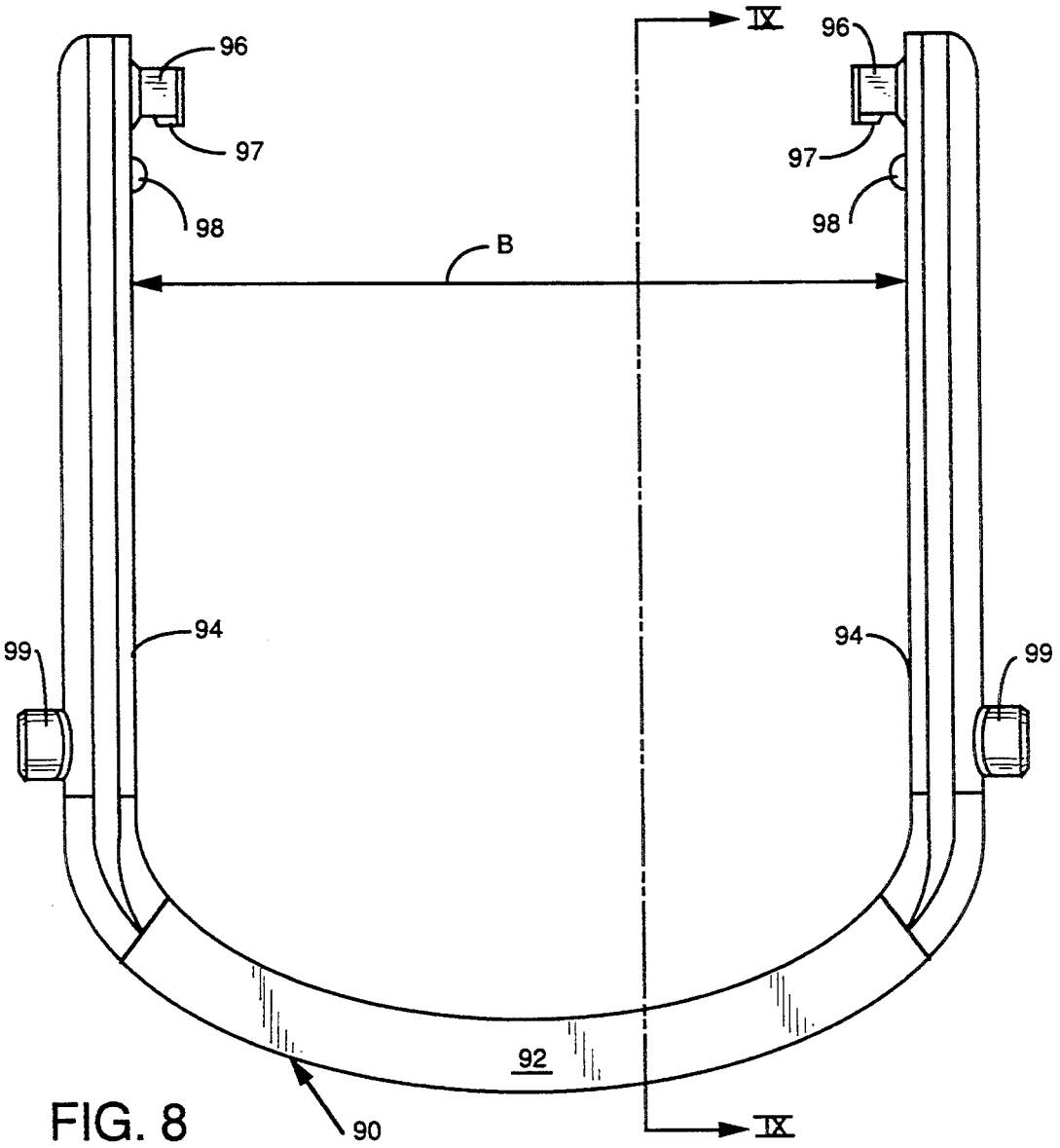
FIG. 8 is a plan view of a preferred handle member of the present invention.
Figure 9:
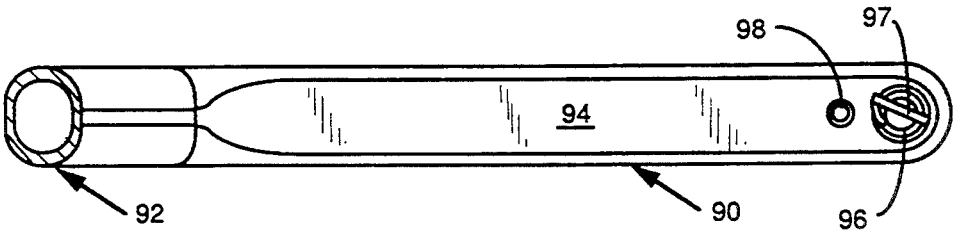
FIG. 9 is a partial cross-sectional view of a preferred handle member taken along line IX—IX in FIG. 8.

A preferred seat member 50 also has a handle member 90 attached thereto. A preferred handle member 90 is illustrated in FIGS. 8 and 9, and comprises a U-shaped member that has an arcuate grippable central portion 92 that has two spaced-apart support arms 94 attached thereto. Preferably, handle member 90 has an oval shaped cross section and is fabricated from polypropylene; however, handle member 90 can be fabricated from other suitable materials in a variety of other shapes and sizes. Each support arm 94 has an inwardly extending pivot pin 96 protruding therefrom which serves to pivotally attach the handle member 90 to the seat member 50 in the manner described below.

More specifically, and with reference to FIGS. 4–6, an upwardly extending support member 72 is formed in each cavity 70 of seat member 50. Each support member 72 has a cradle 75 formed therein that is adapted to pivotally support a corresponding pivot pin 104 of the handle member 100. As can be seen in FIG. 6, the end portion 86 of each tray arm 84 has an arcuate aperture 87 therein that is adapted to confront the corresponding cradle 75 when the tray 80 is attached to the seat member 50. Each aperture 87 cooperates with a corresponding cradle 75 to define a pin receiving aperture, generally designated as 76. To attach the handle member 90 to the seat member 50, the pivot pins 96 are inserted into the corresponding pin receiving apertures 76 so that they may rotate therein. It will be understood that the distance "B" between the support arms 94 (see FIG. 8) is sized such that when the pivot pins 96 are inserted into the corresponding pin receiving apertures 76, the U-shaped handle member 90 will be pivotally attached to the seat member 50.

In a preferred embodiment, each pivot pin 96 has a tab member 97 formed thereon that is adapted to restrict the pivotal motion of the handle member 90 relative to the seat member 50 to a predetermined angular path. In particular, the tab members 97 are adapted to engage the upstanding support member 72 when the handle member 90 is pivoted to a horizontal position wherein it is substantially coplanar with the tray member 80. See FIG. 1. In addition, when the handle member 90 is pivoted to the vertical position as shown in phantom lines in FIG. 1, the tab members 97 each contact a corresponding downwardly extending stop member 85 that is molded on the underside of each end portion 86 of the tray member 80. See FIG. 6. Thus, the tab members 97, in cooperation with the upstanding support members 72 and the stop members 85, serve to limit the pivotal motion of the handle member 90 to a predetermined range of angular motion depicted as angle "C" in FIG. 1. In a preferred embodiment, angle "C" would be approximately 60 degrees. Also in a preferred embodiment, the distance "B" between the handle support arms 94 is sized such that when the handle member 90 is pivoted to a position wherein it is substantially coplanar with the tray 80, there is approximately 1" clearance between the outer circumference of the tray member 80 and the inside perimeter of the handle member 90. See FIG. 13. Such arrangement serves to closely "nest" the tray member 80 inside the handle member opening. Also, in a preferred embodiment, a detent 98 is formed on the inside surfaces of each support arm 94. See FIG. 8. The detents 98 are adapted to engage the outer surfaces of the tray support arms 84 as the handle member 90 is pivoted about axis D—D to retain the handle member 90 in a variety of angular orientations.

Figure 10:
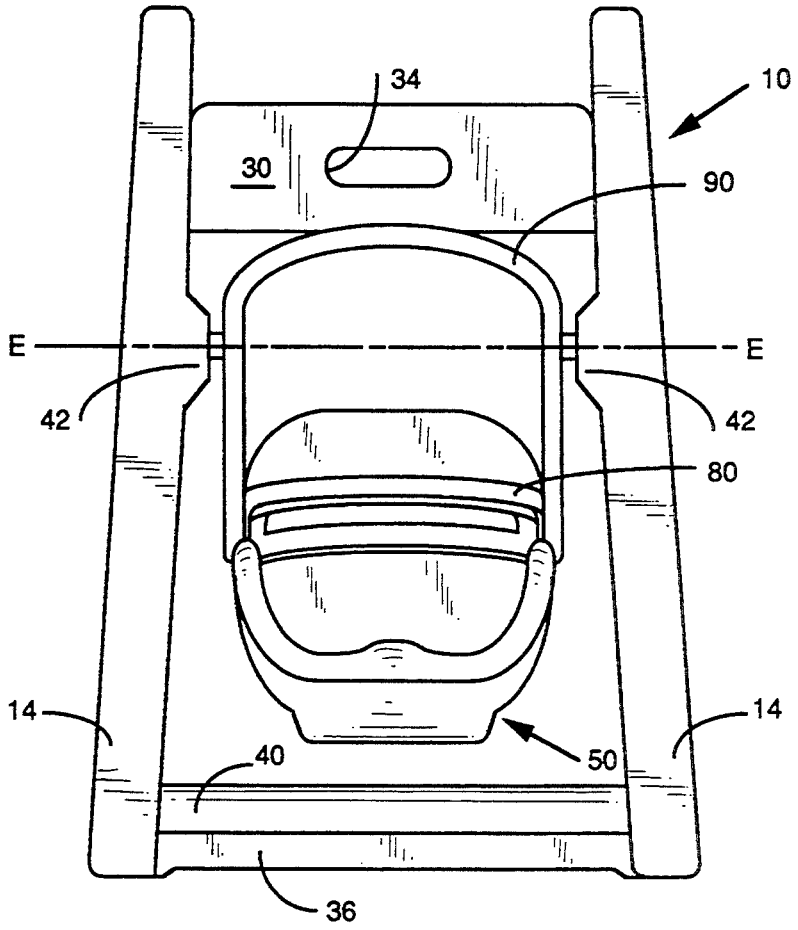
FIG. 10 is a front elevational view of the chair and frame member of the present invention with the chair functioning as a swing.
Figure 11:
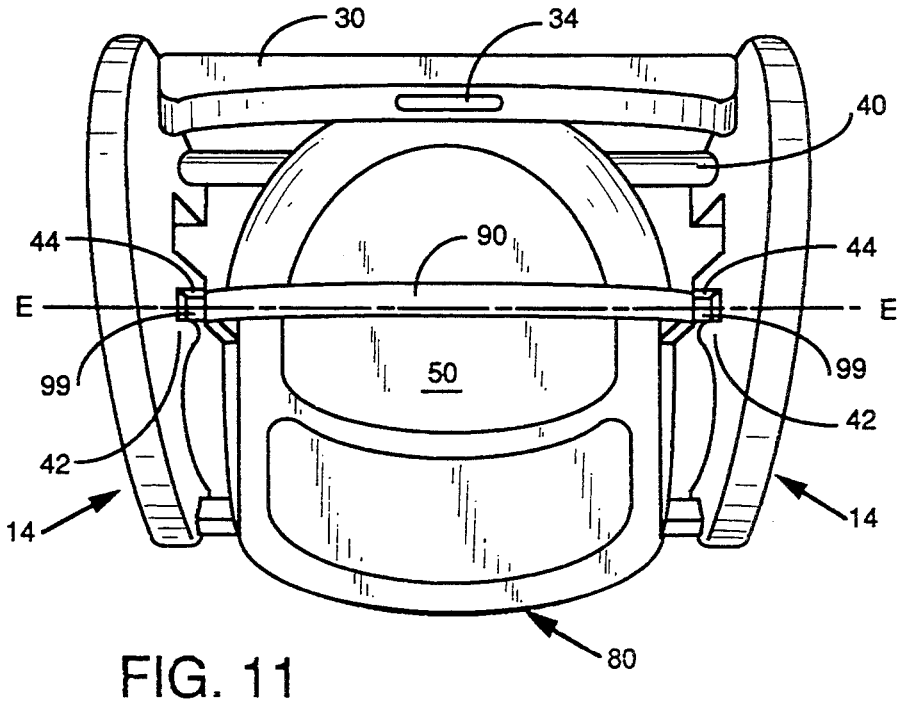
FIG. 11 is a top perspective view of the chair and frame assembly of FIG. 10.
Figure 12:
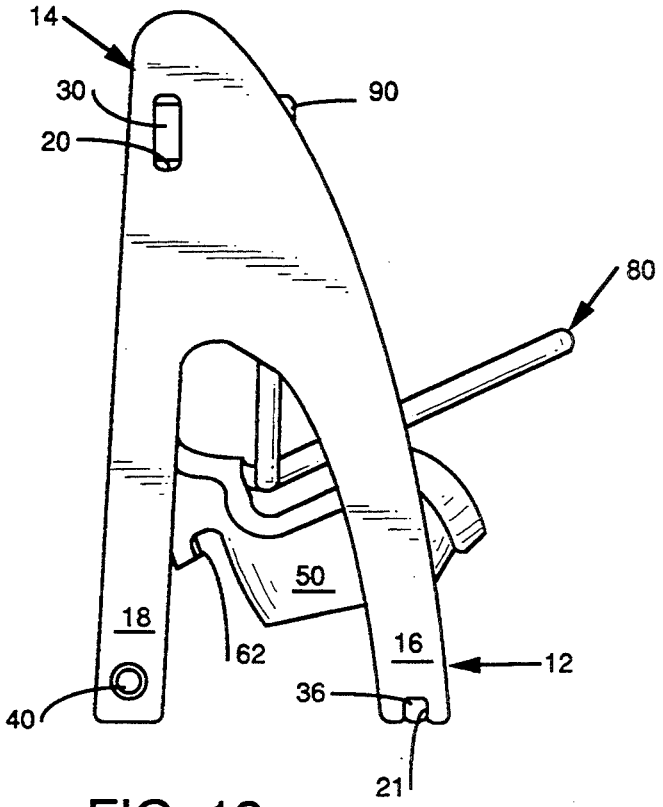
FIG. 12 is a side elevational view of the chair and frame assembly of FIGS. 10 and 11.

The handle member 90 also preferably has a pair of outwardly extending round dowel members 99 attached thereto. More specifically, as shown in FIG. 8, each support arm 94 has an outwardly extending dowel member 99 formed thereon. The dowel members 99 are sized to be pivotally supported in the corresponding swing cradles 42 provided on each upstanding support member 14 of the frame member 12. As can be seen from reference to FIGS. 10 and 11, the cradle members 42 are adapted to support the dowel members 99 such that the dowel members 99 can pivot about pivot axis E—E. Thus, when the seat member 50 is positioned as shown in FIGS. 10–12, the seat member 50 can pivotally swing between the upstanding support members 14.

The reader will appreciate that the subject toy chair apparatus 10, as described above, can perform a variety of functions. In particular, when the clip 62 of the seat member 50 is hooked over the upper crossbrace 30 of the frame member 12, the seat member 50 is rigidly and removably fixed to the frame 12 in a first occupant supporting or highchair-like position. See FIG. 1. In another mode of operation, the seat member 50 can be pivotally suspended from the frame member 12 in a second occupant supporting position by the cooperation between the dowels 99 formed on the handle member 90 and the cradles 42 formed on the upstanding support members 14 of frame 12. Such arrangement permits the seat member 50 to pivotally swing between the upstanding support members 14 and, thus, function as a swing. See FIGS. 10–12.

In addition, if the child desires, the seat member 50 can be completely detached from the frame member 12 and transported by the handle member 90. Therefore, the handle member 90 enables the seat member 50 to function as a portable "baby doll carrier". The bottom surface 53 of the seat member 50 also enables the seat member 50 to be placed on a substantially planar surface (i.e., a floor) and serve as a "floor feeder" wherein the occupant doll is supported in a substantially upright seated position. The reader will also appreciate that the seat member 50 is also shaped such that it could be placed on the seat of an automobile to function as a car seat for a child's doll. When functioning as a car seat, it may be advantageous to pivot the handle 90 member to a position wherein it is coplanar with the tray member 80 to enable a seat belt to extend across the nested handle and tray arrangement to secure the seat member 50 in place. Such arrangement is particularly helpful in emphasizing the importance of seat belt usage to a child.

Accordingly, the present invention is capable of functioning as a highchair, a swing, a baby carrier, a floor feeder and a car seat and thus eliminates the need for separate and often costly devices to perform those functions. It will be understood, however, that various changes in the details, materials and arrangements of parts which have been herein described and illustrated in order to explain the nature of the invention may be made by those skilled in the art within the principle and scope of the invention as expressed in the appended claims.

What is claimed is:

1. A chair, comprising:

a frame member having two upstanding support members interconnected in parallel spaced-apart relationship by transverse connecting means, said support members having facing support elements thereon;

a seat member;

means attached to said seat member for removably attaching said seat member to said frame member in a fixed occupant supporting position; and a handle member attached to said seat member for transporting said seat member apart from said frame member, said handle member sized to be substantially completely received between said upstanding support members and having pivot means attached thereto for detachably suspending said seat member from said support elements to enable said seat member to pivotally swing between said upstanding support members.

2. The chair recited in claim 1 wherein said transverse connecting means comprises at least one transverse crossbrace attached to each said upstanding support member and extending therebetween.

3. The chair recited in claim 2 wherein said means for removably attaching said seat member to said frame member in a fixed occupant supporting position comprises a hook member attached to said seat member, said hook member adapted to engage said transverse crossbrace to removably retain said seat member in said fixed occupant supporting position.

4. The chair recited in claim 1 wherein said handle member comprises a U-shaped member having a central portion and two spaced-apart arm portions pivotally attached to said seat member.

5. The chair recited in claim 4 wherein said pivot means comprises a dowel member attached to each said arm portion and extending therefrom, each said dowel member adapted to be pivotally received and supported in one of said support elements.

6. The chair recited in claim 5 wherein each support element comprises a cradle member formed on a corresponding upstanding support member of said frame member.

7. The chair recited in claim 1 wherein said seat member has an occupant supporting side and an underside opposite said occupant supporting side, said underside having a support area formed therein to enable said seat member to be non-movably supported in a substantially upright occupant supporting position on a substantially planar surface.

8. The chair recited in claim 1 further including a tray member attached to said seat member.

9. The chair recited in claim 8 wherein said handle member is pivotally attached to said seat member and movable between a first substantially vertical position relative to said seat member and a second substantially horizontal position wherein said handle member is substantially coplanar with said tray member.

10. A chair comprising:

a frame member having two upstanding support members interconnected in a spaced-apart relationship by at least one transverse crossbrace, said upstanding support members having facing cradle members formed thereon;

a seat member having an occupant supporting surface, a rear surface, and a bottom surface, said rear surface having a hook member formed thereon adapted to engage one of said transverse cross-braces to removably retain said seat member in a fixed occupant supporting position, said bottom surface having a support area formed therein adapted to support said seat member apart from said frame member in an upright occupant supporting position on a substantially planar surface;

a tray member attached to said seat member; and a handle member comprising a pair of support arms interconnected by a central grippable member, each support arm being pivotally attached to said seat member such that said handle member can pivot between a first substantially vertical position and a second substantially horizontal position, said central member interconnecting said support arms in a spaced-apart relationship to define an opening therebetween which is sized to receive therein said tray member when said handle member is pivoted to said second position, said handle member further having dowel members attached to each said support arm and protruding therefrom to be pivotally supported on a corresponding cradle member on an upstanding support member such that said seat member can pivotally swing between said upstanding support members.

11. A chair, comprising:

a frame member having two upstanding support members interconnected in parallel spaced-apart relationship by transverse connecting means, said support members having facing support elements thereon;

a seat member;

means attached to said seat member for removably attaching said seat member to said frame member in a fixed occupant supporting position; and a U-shaped handle member attached to said seat member for transporting said seat member apart from said frame member, said handle member having a central portion and two spaced-apart arm portions, each said arm portion having a dowel member attached thereto adapted to be pivotally received and supported in a corresponding support element for detachably suspending said seat member from said support elements to enable said seat member to pivotally swing between said upstanding support members.

12. The chair recited in claim 11 wherein each said support element comprises a cradle member formed on a corresponding upstanding support member of said frame member.

13. A chair, comprising:

a frame member having two upstanding support members interconnected in parallel spaced-apart relationship by transverse connecting means, said support members having facing support elements thereon;

a seat member;

a tray member attached to said seat member;

means attached to said seat member for removably attaching said seat member to said frame member in a fixed occupant supporting position; and a handle member attached to said seat member for transporting said seat member from said frame member, said handle member having pivot means attached thereto for detachably suspending said seat member from said support elements to enable said seat member to pivotally swing between said upstanding support members, said handle member being pivotally attached to said seat member and being movable between a first substantially vertical position relative to said seat member and a second substantially horizontal position wherein said handle member is substantially coplanar with said tray member.

* * * * *

UNITED STATES PATENT AND TRADEMARK OFFICE

CERTIFICATE OF CORRECTION

Figure 13:
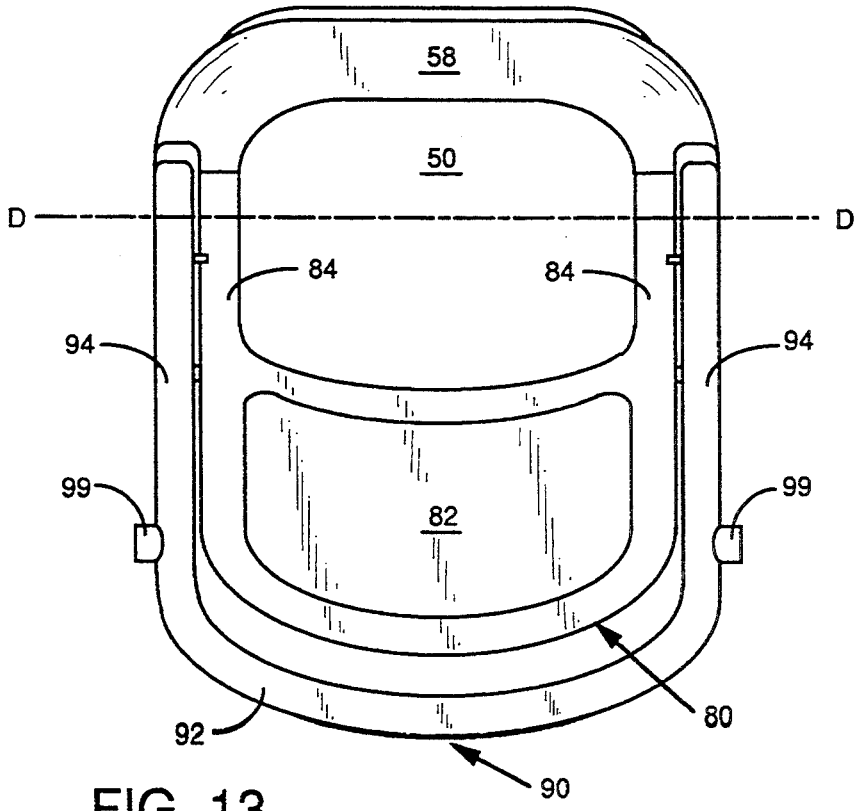

PATENT NO. : 5,413,399
DATED : May 9, 1995
INVENTOR(S) : Peter J. Myers, Philip M. Baerenwald It is certified that error appears in the above-indentified patent and that said Letters Patent is hereby corrected as shown below:

Col. 3, line 35, delete "Fig. 11" and substitute therefor -- Fig. 13 --.

Signed and Sealed this

Twelfth Day of September, 1995

*Attest:*

Bruce Lehman

BRUCE LEHMAN

*Attesting Officer*

*Commissioner of Patents and Trademarks*